US009760046B2

(12) United States Patent
Lim et al.

(10) Patent No.: US 9,760,046 B2
(45) Date of Patent: Sep. 12, 2017

(54) FIXING DEVICE AND ELECTROPHOTOGRAPHIC IMAGE FORMING APPARATUS INCLUDING THE SAME

(71) Applicant: SAMSUNG ELECTRONICS CO., LTD., Suwon-si (KR)

(72) Inventors: Min-ki Lim, Yongin-si (KR); Ki-hyuk Lee, Seoul (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/061,030

(22) Filed: Mar. 4, 2016

(65) Prior Publication Data

US 2016/0274519 A1 Sep. 22, 2016

(30) Foreign Application Priority Data

Mar. 19, 2015 (KR) ..... 10-2015-0038238

(51) Int. Cl.
*G03G 15/20* (2006.01)

(52) U.S. Cl.
CPC . *G03G 15/2053* (2013.01); *G03G 2215/0141* (2013.01); *G03G 2215/2035* (2013.01)

(58) Field of Classification Search
None
See application file for complete search history.

(56) References Cited

U.S. PATENT DOCUMENTS

2012/0008971 A1* 1/2012 Lee ..... G03G 15/2064 399/69
2012/0163886 A1* 6/2012 Suzuki ..... G03G 15/2053 399/329
2013/0195526 A1* 8/2013 Kusahara ..... G03G 9/08797 399/329
2013/0251390 A1* 9/2013 Ishii ..... G03G 15/205 399/67
2014/0286684 A1 9/2014 Takagi et al.

FOREIGN PATENT DOCUMENTS

JP 2014186315 A * 10/2014

* cited by examiner

*Primary Examiner* — Thomas Giampaolo, II
(74) *Attorney, Agent, or Firm* — Staas & Halsey LLP

(57) ABSTRACT

Provided is a fixing device. The fixing device includes: a fixing belt including a base; a nip forming member arranged inside the fixing belt; and a pressing member arranged outside the fixing belt to face the nip forming member to form a fixing nip. The hardness of the nip forming member is configured with respect to the hardness of the base.

30 Claims, 7 Drawing Sheets

FIXING DEVICE AND ELECTROPHOTOGRAPHIC IMAGE FORMING APPARATUS INCLUDING THE SAME

CROSS-REFERENCE TO RELATED APPLICATION

This application claims the benefit of Korean Patent Application No. 10-2015-0038238, filed on Mar. 19, 2015, in the Korean Intellectual Property Office, the disclosure of which is incorporated herein in its entirety by reference.

BACKGROUND

1. Field

The present disclosure relates to a fixing device including a fixing belt and an electrophotographic image forming apparatus including the fixing device.

2. Description of the Related Art

An electrophotographic image forming apparatus may supply a toner to an electrostatic latent image formed at an image receptor, form a visible toner image on the image receptor, transfer the toner image to a recording medium, and fix the transferred toner image to the recording medium. The toner may be manufactured by adding various functional additives including a colorant to a base resin. A fixing process may include a process of applying heat and pressure to the toner.

A belt fixing mechanism including a fixing belt and a pressing roller may be used as a fixing device. The fixing belt may be heated by a heat source such as a lamp. The pressing roller and a nip forming member may be disposed respectively outside and inside the fixing belt and be pressed to each other. Accordingly, a fixing nip may be formed. The fixing belt may be driven according to the rotation of the pressing roller. In the fixing process, the fixing belt and the nip forming member may frictionally contact each other. Wear of the fixing belt and the nip forming member may cause problems such as an increase in the driving load of the fixing device and damage to the nip forming member and/or the fixing belt.

SUMMARY

Provided are a fixing device capable of reducing a risk of damage to a fixing belt and an electrophotographic image forming apparatus including the fixing device.

Additional aspects will be set forth in part in the description which follows and, in part, will be apparent from the description, or may be learned by practice of the presented embodiments.

According to an aspect of an embodiment, a fixing device includes: a fixing belt including a film-type base; a nip forming member arranged inside the fixing belt; and a pressing member arranged outside the fixing belt to face the nip forming member to form a fixing nip, wherein the hardness of the nip forming member is more than or equal to the hardness of the base.

The nip forming member and the base may include the same metal.

The base may include a stainless steel film; and the nip forming member may include any one of stainless steel and nickel.

The nip forming member may have a Vickers hardness of about 100 to about 810.

The nip forming member may have a thickness of about 0.1 mm to about 1.0 mm.

The nip forming member may include: a substrate; and a friction reducing coating layer provided at the surface of the substrate facing the fixing belt; and the hardness of the substrate may be more than or equal to the hardness of the base.

The fixing device may further include a friction reducing sheet interposed between the nip forming member and the fixing belt.

The fixing device may further include a lubricating member supplying a lubricant between the nip forming member and the fixing belt. The fixing device may further include a support member arranged inside the nip forming member to support the nip forming member, wherein the support member may be provided with a lubricating groove in which the lubricating member is disposed; and the nip forming member may be provided with a through groove through which the lubricant supplied from the lubricating member passes.

The fixing device may further include: a heating member heating the fixing belt; and a reflecting plate reflecting thermal energy toward the nip forming member from among thermal energy of the heating member to the fixing belt.

The fixing device may further include: a heating member heating a fixing member in the fixing nip indirectly through the nip forming member; and a reflecting plate reflecting thermal energy from the heating member to the nip forming member.

According to an aspect of another embodiment, a fixing device includes: a flexible fixing belt including a metal base; a nip forming member arranged inside the fixing belt and including a metal substrate; and a pressing member arranged outside the fixing belt to face the nip forming member to form a fixing nip, wherein the substrate and the base have a Vickers hardness of about 100 to about 810.

The hardness of the substrate may be more than or equal to the hardness of the base.

The substrate and the base may include the same metal.

The base may include stainless steel; and the substrate may include any one of stainless steel and nickel.

The nip forming member may have a thickness of about 0.1 mm to about 1.0 mm.

The nip forming member may further include a friction reducing coating layer provided at the surface of the substrate facing the fixing belt. The fixing device may further include a lubricating member supplying a lubricant between the nip forming member and the fixing belt. The fixing device may further include a support member arranged inside the nip forming member to support the nip forming member, wherein the support member may be provided with a lubricating groove in which the lubricating member is disposed; and the nip forming member may be provided with a through groove through which the lubricant supplied from the lubricating member passes.

According to an aspect of another embodiment, an electrophotographic image forming apparatus includes: a printing unit configured to form a visible toner image on a recording medium; and the above fixing device configured to fix the toner image on the recording medium.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
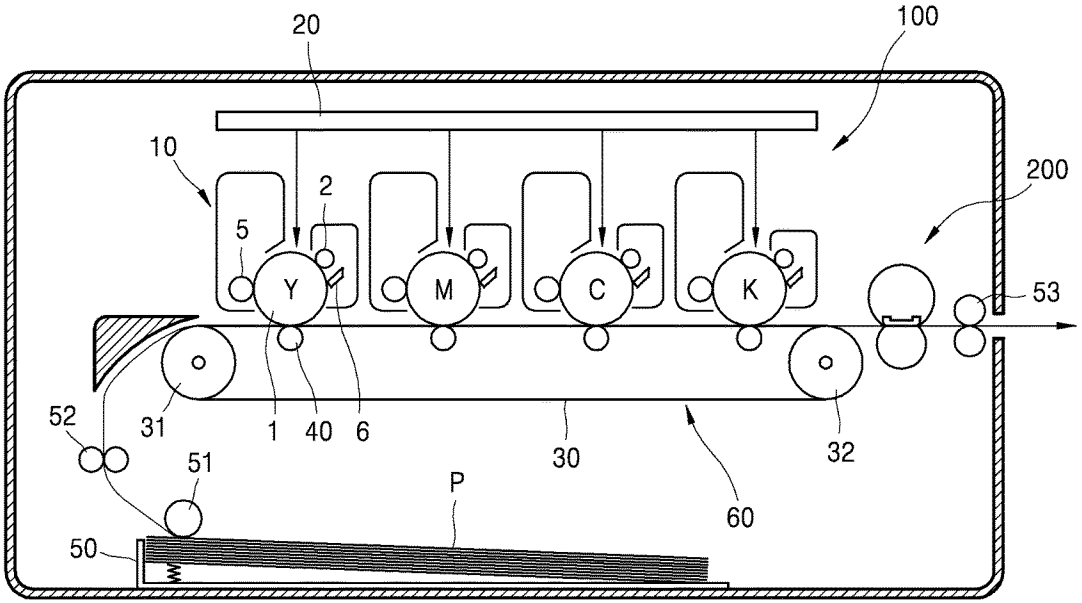
FIG. 1 is a schematic diagram illustrating an embodiment of an electrophotographic image forming apparatus.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items. Expressions such as "at least one of," when preceding a list of elements, modify the entire list of elements and do not modify the individual elements of the list.

Hereinafter, embodiments of a fixing device and an electrophotographic image forming apparatus including the same will be described with reference to the drawings.

FIG. 1 is a schematic diagram illustrating an embodiment of an electrophotographic image forming apparatus. Referring to FIG. 1, the electrophotographic image forming apparatus may include: a printing unit 100 for forming a visible toner image on a recording medium P, for example, paper; and a fixing device 200 for fixing the toner image on the recording medium P. According to the present embodiment, the printing unit 100 forms a color toner image electrophotographically.

The printing unit 100 may include a plurality of photosensitive drums 1, a plurality of developing devices 10, and a transferer 60. As an example of a photoconductor on the surface of which an electrostatic latent image is formed, the photosensitive drum 1 may include a conductive metal pipe and a photosensitive layer formed at the outer periphery thereof. The developing devices 10 correspond respectively to the photosensitive drums 1, and each developing device 10 supplies a toner to an electrostatic latent image formed on each photosensitive drum 1 and develops the latent image to form a toner image on the surface of each photosensitive drum 1. Each of the developing devices 10 may be in the form of a cartridge including the photosensitive drum 1. The cartridge may be replaced when the toner accommodated therein is exhausted. The developing devices 10 may be replaced independently of the photosensitive drums 1 respectively.

For color printing, the developing devices 10 may include a plurality of developing devices 10Y, 10M, 10C, and 10K receiving toners of yellow (Y), magenta (M), cyan (C), and black (K) colors. The developing devices 10 may further include other developing devices receiving toners of various colors such as light magenta and white, other than the above colors.

An image forming apparatus including a plurality of developing devices 10Y, 10M, 10C, and 10K will be described below. Unless otherwise specified, reference numerals appended with Y, M, C, and K respectively denote components for printing images by using toners of yellow (Y), magenta (M), cyan (C), and black (K) colors.

The developing device 10 supplies a toner received therein to an electrostatic latent image formed on the photosensitive drum 1 and develops the electrostatic latent image into a visible toner image. The developing device 10 may include a developing roller 5. The developing roller 5 supplies a toner in the developing device 10 to the photosensitive drum 1. A developing bias voltage may be applied to the developing roller 5. A restricting member (not illustrated) restricts the amount of a toner that is supplied by the developing roller 5 to a developing region where the photosensitive drum 1 and the developing roller 5 face each other.

In the case of using a dual-component developing mechanism, a magnetic carrier and a toner are received in the developing device 10, and the developing roller 5 is spaced apart from the photosensitive drum 1 by tens of microns to hundreds of microns. Although not illustrated, the developing roller 5 may include a rotary hollow cylindrical sleeve and a magnetic roller arranged in the sleeve. The toner is attached to the surface of the magnetic carrier. The magnetic carrier is attached to the surface of the sleeve and transported to the developing region where the photosensitive drum 1 and the developing roller 5 face each other. Only the toner is supplied to the photosensitive drum 1 by the developing bias voltage applied between the developing roller 5 and the photosensitive drum 1, and thus the electrostatic latent image formed at the surface of the photosensitive drum 1 is developed into a visible toner image. In the case of using a dual-component developing mechanism, the developing device 10 may include an agitator (not illustrated) that mixes and agitates the toner and the magnetic carrier and transports the result thereof to the developing roller 5. The agitator may be, for example, an auger, and the developing device 10 may be provided with a plurality of agitators.

In the case of using a mono-component developing mechanism not using the magnetic carrier, the developing roller 5 may be rotated in contact with the photosensitive drum 1 or may be rotated while being spaced apart from the photosensitive drum 1 by tens of microns to hundreds of microns. The developing device 10 may further include a supply roller (not illustrated) for attaching a toner received therein to the surface of the developing roller 5. A supply bias voltage may be applied to the supply roller. The developing device 10 may further include an agitator (not illustrated). The agitator may agitate the toner to be frictionally charged. The agitator may be, for example, an auger.

A charging roller 2 is an example of a charger for charging the photosensitive drum 1 to have a uniform surface potential. For example, a charging brush or a corona charger may be used instead of the charging roller 2.

A cleaning blade 6 is an example of a cleaning unit for removing the impurity and the toner remaining on the surface of the photosensitive drum 1 after a transfer process. Any other type of cleaning unit such as a rotary brush may be used instead of the cleaning blade 6.

Although an example of a developing mechanism of the image forming apparatus according to an embodiment has been described above, various modifications and changes may be made in the developing mechanism.

An exposer 20 irradiates light, which is modulated corresponding to image information, to photosensitive drums 1Y, 1M, 1C, and 1K to form electrostatic latent images corresponding to images of yellow (Y), magenta (M), cyan (C), and black (K) colors on the photosensitive drums 1Y, 1M, 1C, and 1K, respectively. The exposer 20 may include, for example, a laser scanning unit (LSU) using a laser diode as a light source or a light emitting diode (LED) exposer using an LED as a light source.

The transferer 60 transfers the toner images formed on the photosensitive drums 1Y, 1M, 1C, and 1K to the recording medium P. For example, the transferer 60 may include a paper transport belt 30 for supporting and transporting the recording medium P. For example, the paper transport belt 30 may circulate while being supported by support rollers 31 and 32. A plurality of transfer rollers 40 are arranged at positions facing the photosensitive drums 1Y, 1M, 1C, and 1K, with the paper transport belt 30 interposed therebetween. A transfer bias voltage for transferring the toner image from the photosensitive drums 1Y, 1M, 1C, and 1K to the recording medium P supported by the paper transport belt 30 is applied to the transfer rollers 40. A corona discharger or a pin scorotron discharger may be used instead of the transfer roller 40.

The recording mediums P may be picked up one by one from a loading frame 50 by a pickup roller 51, transported by a transport roller 52, and then attached to the paper transport belt 30, for example, by an electrostatic force.

The fixing device 200 applies heat and/or pressure to the image, which is transferred to the recording medium P, to fix the image to the recording medium P. The recording medium P passing out through the fixing device 200 is discharged by a discharge roller 53.

By the above configuration, the exposer 20 forms an electrostatic latent image by irradiating the lights, which are modulated corresponding to the image information of the respective colors, to the photosensitive drums 1Y, 1M, 1C, and 1K respectively. The developing devices 10Y, 10M, 10C, and 10K form visible toner images of Y, M, C, and K colors at the surfaces of the photosensitive drums 1Y, 1M, 1C, and 1K respectively by supplying the toners of Y, M, C, and K colors to the electrostatic latent images formed on the photosensitive drums 1Y, 1M, 1C, and 1K respectively. The recording medium P loaded on the loading frame 50 is supplied to the paper transport belt 30 by the pickup roller 51 and the transport roller 52 and is held on the paper transport belt 30, for example, by an electrostatic force. The toner images of Y, M, C, and K colors are sequentially transferred, by the transfer bias voltages applied to the transfer rollers 40, onto the recording medium P transported by the paper transport belt 30. When the recording medium P passes out through the fixing device 200, the toner image is fixed to the recording medium P by heat and pressure. Upon completion of the fixing, the recording medium P is discharged by the discharge roller 53.

Although FIG. 1 illustrates that the image forming apparatus uses a mechanism for directly transferring the toner image developed on the photosensitive drums 1Y, 1M, 1C, and 1K to the recording medium P supported by the paper transport belt 30, the scope of the inventive concept is not limited thereto. For example, the toner image developed on the photosensitive drums 1Y, 1M, 1C, and 1K may be intermediately transferred to an intermediate transfer belt and then transferred to the recording medium P. Since the intermediate transfer mechanism is well known in the art, detailed descriptions thereof will be omitted herein.

Figure 2:
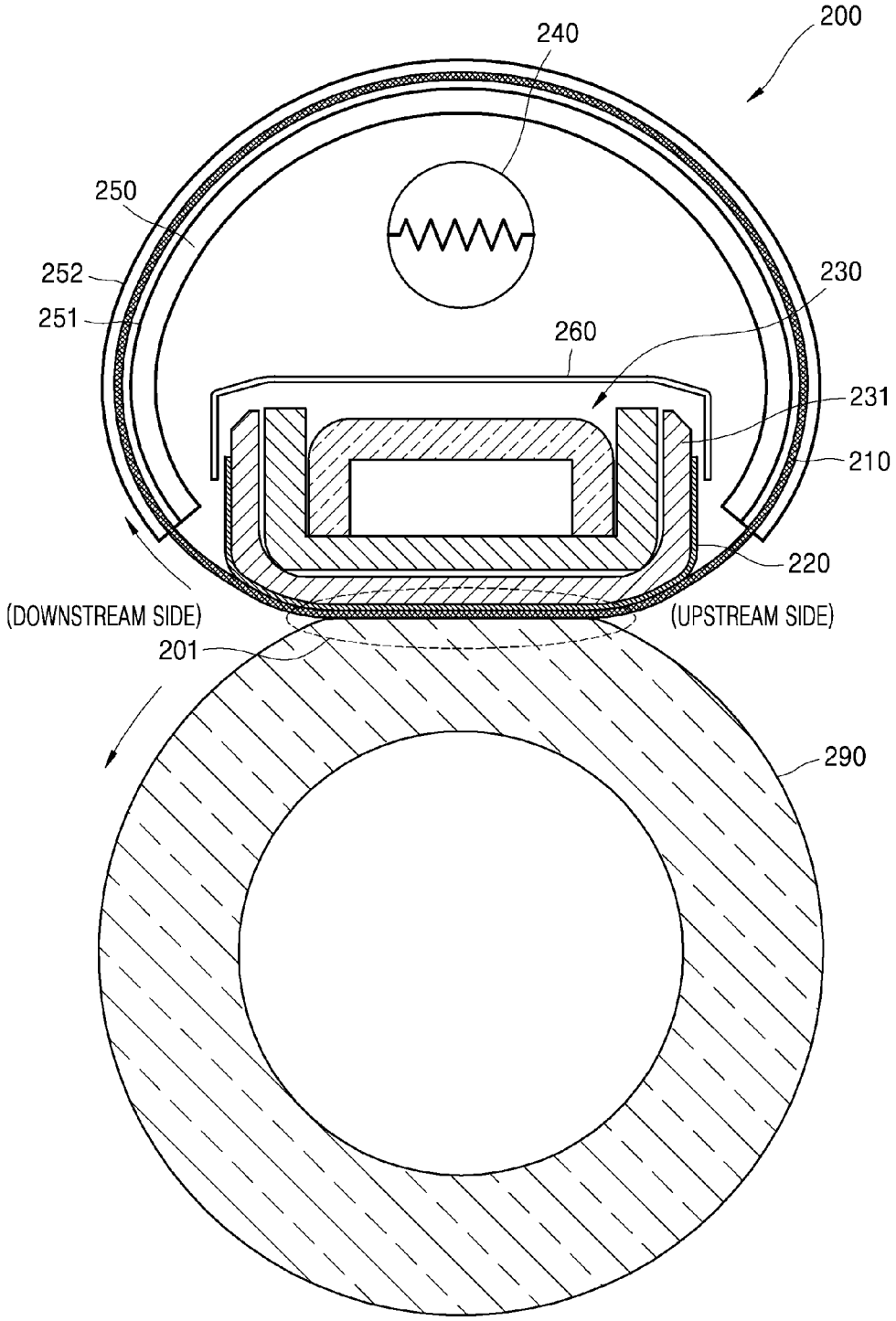
FIG. 2 is a cross-sectional view illustrating an embodiment of a fixing device.

The fixing device 200 applies heat and pressure to the toner image to fix the image to the recording medium P. A thermal capacity of a heated portion of the fixing device 200 may be reduced in order to improve the printing speed thereof and reduce energy consumption thereof. For this purpose, the fixing device 200 may use a thin film-type fixing belt as the heated portion. FIG. 2 is a cross-sectional view illustrating an embodiment of the fixing device 200.

Referring to FIG. 2, the fixing device 200 includes: a rotary fixing belt 210; a nip forming member 220 arranged inside the fixing belt 210; and a pressing member 290 arranged outside the fixing belt 210 to face the nip forming member 220 to form a fixing nip 201 together with the nip forming member 220. A heating member 240 is arranged inside the fixing belt 210 to directly heat the fixing belt 210. For example, a halogen lamp may be used as the heating member 240.

Figure 3:
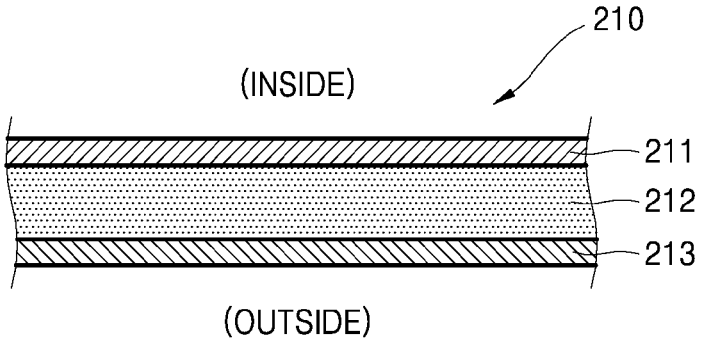
FIG. 3 is a cross-sectional view illustrating an example of a fixing belt.

FIG. 3 is a cross-sectional view illustrating an example of the fixing belt 210. Referring to FIG. 3, the fixing belt 210 may include a film-type base 211. The base 211 may be, for example, a thin metal film. The thickness of the base 211 may be selected so that the fixing belt 210 may have flexibility and elasticity such that it may be flexibly deformed in the fixing nip 201 and may be restored to its original state after deviating from the fixing nip 201. For example, a stainless steel film or a nickel film may be used as the base 211. The thickness of the base 211 may be about tens of microns to about hundreds of microns. For example, the thickness of the base 211 may be about 35 microns.

The outermost layer of the fixing belt 210 may be a release layer 213. There may occur an offset phenomenon in which the toner on the recording medium P melts and becomes attached to the fixing belt 210 in a fixing process. The offset phenomenon may cause a printing defect in which a portion of the print image on the recording medium P is omitted, and a jam in which the recording medium P deviating from the fixing nip 201 is attached to the outer surface of the fixing belt 210 without being separated from the fixing belt 210. The release layer 213 may be formed to include a polymer layer having excellent separability. The release layer 213 may include, for example, any one of silicone polymer, perfluoroalkoxy (PFA), polytetrafluoroethylenes (PTFE), fluorinated polyetherketones (PEEK), and fluorinated ethylene propylene (FEP), any blend thereof, or any copolymer thereof.

The fixing belt 210 may further include an elastic layer 212. The elastic layer 212 may be interposed between the base 211 and the release layer 213. In order to easily form the fixing nip 201, the elastic layer 212 may be formed of a heat-resistant material capable of enduring at fixing temperatures. For example, the elastic layer 212 may include a silicone polymer. The thickness of the elastic layer 212 may be, for example, about 200 μm.

Although not illustrated, a black layer for absorbing the light irradiated from the lamp-type heating member 240 may be provided at the inner peripheral surface of the fixing belt 210, that is, at the inner peripheral surface of the base 211.

The nip forming member 220 is arranged inside the fixing belt 210. The pressing member 290 facing the nip forming member 220 is arranged outside the fixing belt 210. The nip forming member 220 and the pressing member 290 are pressed mutually with the fixing belt 210 interposed therebetween. For example, a support member 230 may be arranged inside the fixing belt 210 to support the nip forming member 220 with respect to the pressing member 290. An elastic member (not illustrated) may apply an elastic force to the support member 230 to press the nip forming member 220 toward the pressing member 290.

The pressing member 290 may drive the fixing belt 210. For example, the pressing member 290 may be in the form of a roller with an elastic layer provided at the outer periphery of a metal core. This pressing member 290 will be referred to as a pressing roller. The pressing member 290 may drive the fixing belt 210 by being rotated while being pressed with the fixing belt 210 interposed between the pressing member 290 and the nip forming member 220.

A reflecting plate 260 may be arranged between the heating member 240 and the support member 230. The reflecting plate 260 reflects thermal energy toward the support member 230 and the nip forming member 220, among thermal energy (e.g., light) from the heating member 240, to the fixing belt 210. Accordingly, since a time taken to heat the fixing belt 210 to the fixing temperature may be reduced, a time taken for first printing (i.e., the first print out time (FPOT)) may be reduced and the heating efficiency thereof may be improved.

While forming the fixing nip 201 together with the pressing member 290, the nip forming member 220 functions as a guide member for guiding the fixing belt 210 to be driven. The nip forming member 220 may be in the form of a plate contacting the inner peripheral surface of the fixing belt 210. The plate-shaped nip forming member 220 will be referred to as a nip plate. According to the present embodiment, the nip forming member 220 forms a flat fixing nip 201 together with the pressing member 290. For this purpose, a portion of the nip forming member 220 corresponding to the fixing nip 201 has a flat shape. The nip forming member 220 is supported by the support member 230. The support member 230 distributes a pressing force of an elastic member (not illustrated) for forming the fixing nip 201, uniformly over the nip forming member 220. Also, the support member 230 reinforces the rigidity of the nip forming member 220 to prevent deformation of the nip forming member 220.

The support member 230 may include a heat insulating member 231 that is arranged inside the nip forming member 220, that is, at an opposite side of the fixing belt 210 opposite the pressing member 290. The heat insulating member 231 prevents the heat of the fixing belt 210 from being transmitted through the nip forming member 220 to the support member 230.

There is friction between the fixing belt 210 and the nip forming member 220. In order to reduce the friction, a lubricant (e.g., grease) may be directly applied (coated) between the inner peripheral surface of the fixing belt 210 and the nip forming member 220. The lubricant may be directly applied between the inner peripheral surface of the fixing belt 210 and the nip forming member 220.

Figure 4:
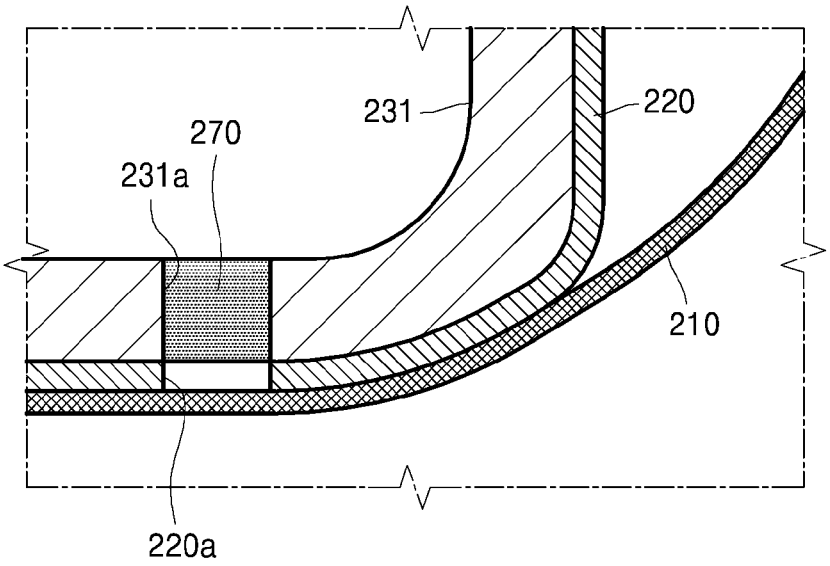
FIG. 4 is a partial cross-sectional view illustrating an embodiment of a fixing device including a lubricating unit.

The fixing device 200 may further include a lubricating unit. FIG. 4 illustrates an embodiment of the fixing device 200 including a lubricating unit. Referring to FIG. 4, a lubricating groove 231*a* is provided at the support member 230, for example, at the heat insulating member 231. A lubricating member 270 for supplying a lubricant is arranged at the lubricating groove 231*a*. The lubricating member 270 may be, for example, in the form of a fiber or a porous sponge impregnated with a lubricant. The nip forming member 220 may be provided with a through groove 220*a* through which the lubricant supplied from the lubricating member 270 passes.

Figure 5:
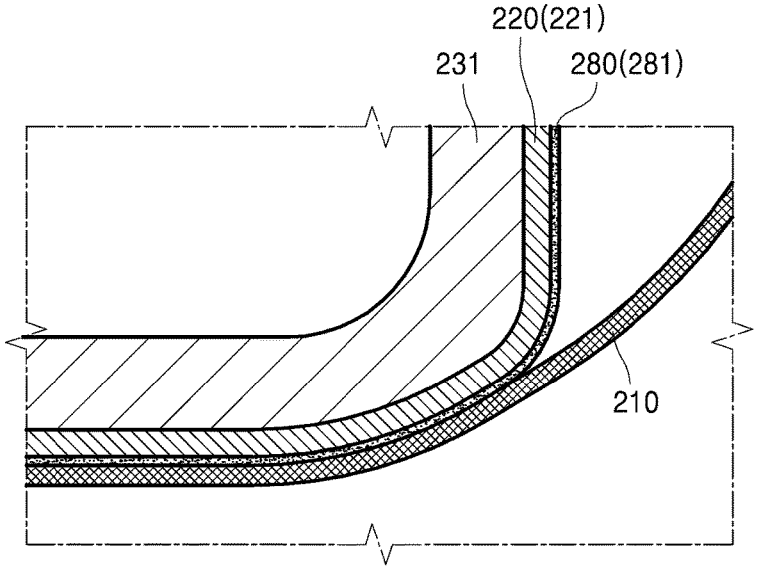
FIG. 5 is a partial cross-sectional view illustrating an embodiment of a fixing device.

The fixing device 200 may further include a friction reducing member for reducing the friction between the nip forming member 220 and the fixing belt 210. FIG. 5 is a partial cross-sectional view illustrating an embodiment of the fixing device 200. Referring to FIG. 5, the friction reducing member is interposed between the nip forming member 220 and the fixing belt 210. As an embodiment, the friction reducing member may be implemented in the form of a friction reducing layer 281 formed at the outer peripheral surface of the nip forming member 220. For example, the nip forming member 220 may include a metal substrate 221 and a friction reducing layer 281 formed at the outer peripheral surface thereof. The friction reducing layer 281 may be, for example, a heat-resistant resin coating layer including polytetrafluoroethylenes (PTFE), fluorinated polyetherketones (PEEK), and/or fluorinated ethylene propylene (FEP). A ceramic protective layer may be further formed outside the heat-resistant resin coating layer.

The thickness of the friction reducing layer 281 may be, for example, about 5 μm to about 100 μm. When the friction reducing layer 281 is too thin, the adjustment of the thickness thereof may be difficult in a coating process and the surface hardness of the friction reducing layer 281 may not be secured and thus it may be damaged by the friction with the fixing belt 210. When the friction reducing layer 281 is too thick, a surface crack may occur in a heat treatment process after the coating process. The surface crack may increase the friction of the friction reducing layer 281.

As an embodiment, the friction reducing member may be implemented in the form of a friction reducing sheet 280 interposed between the nip forming member 220 and the fixing belt 210. The friction reducing sheet 280 may be, for example, a heat-resistant resin sheet including polytetrafluoroethylenes (PTFE), fluorinated polyetherketones (PEEK), and/or fluorinated ethylene propylene (FEP). A ceramic protective layer may be further formed outside the heat-resistant resin sheet.

The lubricating unit illustrated in FIG. 4 may also be applied in the fixing device 200 illustrated in FIG. 5. In this case, the through groove 220*a* may be formed to pass through the friction reducing layer 281 or the friction reducing sheet 280.

Referring to FIG. 2, the fixing device 200 may further include a guide member 250 for guiding the fixing belt 210 to be stably driven. The guide member 250 may include an inner guide portion 251 spaced apart inward from the inner peripheral surface of the fixing belt 210 and an end guide portion 252 for guiding both widthwise end portions of the fixing belt 210.

According to the above configuration, the fixing belt 210 is in the form of a free curve that is restricted locally only near the fixing nip 201 and is deformed freely by its own rigidity in the other region. The fixing belt 210 is driven by the driving force received from the pressing member 290. Then, the upstream side of the fixing belt 210 with respect to the fixing nip 201 is in a tensed state and the downstream side thereof is in a relaxed state.

The wear of the members forming the fixing nip 201, such as, for example, the nip forming member 220 and the fixing belt 210 may greatly affect the printing quality thereof. Since the lubricant is exposed to the heat provided by the heating member 240, the lubricating performance thereof may degrade with the lapse of time. Then, the friction reducing member may be primarily worn, and the nip forming member 220 may start to be worn when the friction reducing member is completely worn. Since the nip forming member 220 is worn, the outer peripheral surface of the nip forming member 220 is roughed and thus the friction with the fixing belt 210 increases. Accordingly, the increase in the driving load of the fixing device 200 may cause, for example, slipping of the fixing belt 210, damage to the nip forming member 220, damage to the fixing belt 210, damage to gears of a driving system for driving the fixing device 200, and jamming of the paper in the fixing device 200.

According to various wear test results of the fixing device 200, it is seen that the widthwise end portion of the nip forming member 220 with a relatively great pressing force applied thereto starts to wear and a range of the wearing expands gradually to the widthwise center portion thereof, thus causing damage to the nip forming member 220 or the fixing belt 210. The wear caused by friction depends on the hardness of two members having the friction therebetween. When the hardness of the nip forming member 220 is lower than the hardness of the fixing belt 210, the nip forming member 220 is easily worn resulting in the surface thereof becoming rough. Thus, the wear of the nip forming member 220 may be prevented or reduced by setting the hardness of the nip forming member 220 to be equal to or higher than the hardness of the fixing belt 210.

For example, the base 211 of the fixing belt 210 and the substrate 221 of the nip forming member 220 may include the same metal. Also, for example, when the base 211 of the fixing belt 210 includes stainless steel such as SUS304 ½H, the substrate 221 of the nip forming member 220 may include stainless steel or nickel having a hardness equal to or higher than the hardness of the stainless steel of the base 211.

Samples such as those shown in Table 1 below are prepared to check the property change of the fixing device 200 depending on the material of the substrate 221 of the nip forming member 220. For example, a stainless steel film such as SUS304 ½H is used as the base 211 of the fixing belt 210. The hardness of the substrate 221 of the nip forming member 220 is lower than the hardness of the base 211 of the fixing belt 210 in Sample #1, and the hardness of the substrate 221 of the nip forming member 220 is equal to the hardness of the base 211 of the fixing belt 210 in Samples #2 and #3. A PTFE+ceramic coating layer with a thickness of 30 μm is used as the friction reducing layer 281 in Samples #1 and #2, and the friction reducing layer 281 is not used in Sample #3.

TABLE 1

| Sample No. | Material | Thickness (mm) | Thermal Capacity (J/cc · ° C.) | Hardness (Vickers) |
|---|---|---|---|---|
| #1 | AL5052 H32 | 0.3 | 2.36 | 68 |
| #2 | SUS304 ½H | 0.2 | 4.00 | 250 |
| #3 | SUS304 ½H | 0.2 | 4.00 | 250 |

Figure 6:
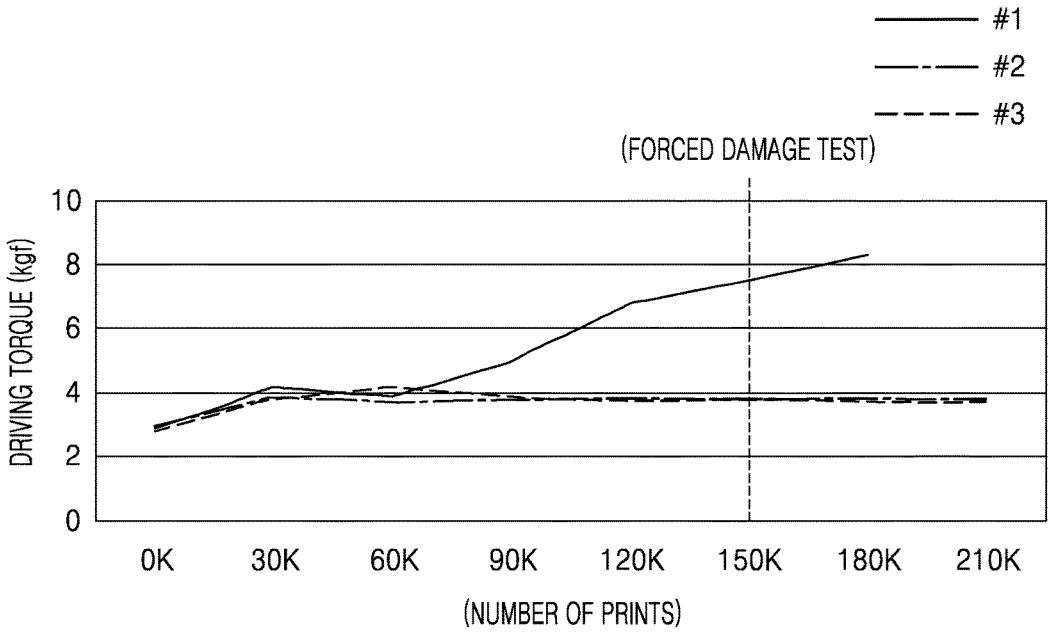
FIG. 6 is a graph illustrating wear test results.

FIG. 6 is a graph illustrating the wear test results. Referring to FIG. 6, in the case of Sample #1, the driving torque of the fixing device 200 increases rapidly after the printing of 60,000 copies. Also, when a portion of the inner peripheral surface of the fixing belt 210 is forcibly damaged after the printing of 150,000 copies (i.e., the standard lifetime of the fixing device 200), the fixing belt 210 is completely damaged at the level of 180,000 copies in the case of Sample #1.

However, in the case of Samples #2 and #3, a certain level of driving torque is maintained until 150,000 copies (i.e., the standard lifetime of the fixing device 200) without damage to the nip forming member 220 or the fixing belt 210, and a certain level of driving torque is maintained until 210,000 copies without damage to the nip forming member 220 or the fixing belt 210 even when a portion of the inner peripheral surface of the fixing belt 210 is forcibly damaged after the printing of 150,000 copies. Although not illustrated in the graph of FIG. 6, in the case of Samples #2 and #3, even after the printing of 435,000 copies (i.e., about 2.9 times the standard lifetime of the fixing device 200), the fixing device 200 operates normally without problems such as the increase of the driving torque and the damage to the nip forming member 220 and the fixing belt 210.

The measurement results of the fixity and the FPOT are shown in Table 2 below. Referring to Table 2, the same or higher level of fixity and FPOT may be obtained even when the hardness of the nip forming member 220 is changed. However, the fixity may be somewhat reduced in the case of not using the friction reducing layer 281, but this problem may be solved by a fixing control process for adjusting the fixing temperature and the like.

TABLE 2

| | Fixity (%) | | |
|---|---|---|---|
| Sample No. | Solid | 2BY2 | FPOT (sec) |
| #1 | 85.7 | 88.7 | 16.4 |
| #2 | 91.3 | 86.1 | 16.2 |
| #3 | 79.4 | 83.9 | 15.6 |

Table 3 below shows the wear test results depending on a combination of the materials of the nip forming member 220 and the fixing belt 210, whether the friction reducing member is used, and whether the lubricating member is used. This is the result of checking the wear and damage states of the fixing device 200 by disassembling the fixing device 200 after the printing of 150,000 copies (i.e., the standard lifetime of the fixing device 200), forcibly damaging a portion of the inner peripheral surface of the fixing belt 210, and then continuing to operate the fixing device 200.

TABLE 3

| | Nip Forming Member | Belt | Friction Reducing Member | Lubricating Member | Nip Forming Member Damage | Belt Damage |
|---|---|---|---|---|---|---|
| Comparative Example 1 | AL5052 H32 | SUS304 ½H | PTFE | Unapplied | Damaged | Damaged |
| Comparative Example 2 | AL5052 H32 | SUS304 ½H | PTFE | Applied | Damaged | Damaged |
| Embodiment 1 | SUS304 ½H | SUS304 ½H | PTFE | Unapplied | Undamaged | Undamaged |

TABLE 3-continued

| | Nip Forming Member | Belt | Friction Reducing Member | Lubricating Member | Nip Forming Member Damage | Belt Damage |
|---|---|---|---|---|---|---|
| Embodiment 2 | SUS304 ½H | SUS304 ½H | PTFE | Applied | Undamaged | Undamaged |
| Embodiment 3 | SUS304 ½H | SUS304 ½H | Unapplied | Unapplied | Undamaged | Undamaged |

In the case of Comparative Examples 1 and 2 in which the hardness of the substrate 221 of the nip forming member 220 is lower than the hardness of the base 211 of the fixing belt 210, even when the friction reducing member and the lubricating member are used, the nip forming member 220 and the fixing belt 210 are damaged at both widthwise end portions thereof and the substrate 221 of the nip forming member 220 is exposed at the widthwise center portion thereof due to the wear of the friction reducing member.

However, in the case of Embodiments 1 to 3 in which the hardness of the substrate 221 of the nip forming member 220 is equal to the hardness of the base 211 of the fixing belt 210, the nip forming member 220 and the fixing belt 210 are not damaged and the friction reducing member is less worn at the both widthwise end portions and the center portion thereof. Even when the friction reducing member and the lubricating member are not used, the nip forming member 220 and the fixing belt 210 are in a good state so that they may continue to be used.

In this manner, by using the material having a hardness equal to or higher than the hardness of the base 211 of the fixing belt 210 as the substrate 221 of the nip forming member 220, the increase of the driving torque caused by the wear and the damage to the fixing belt 210 may be prevented. By using the friction reducing member, the driving torque increase and the member damage risk may be reduced. Also, by applying the lubricant or using the lubricating member, the driving torque increase and the member damage risk may be further reduced.

Table 4 below shows the results of checking information about the occurrence/nonoccurrence of damage after operation for the standard lifetime of the fixing device 200 using various metal materials for the nip forming member 220 and the fixing belt 210.

TABLE 4

| Nip Forming Member (Hardness) | Fixing Belt (Hardness) | Damaged/Undamaged | Determination |
|---|---|---|---|
| Al5052 H32 (68) | SUS304 ½H (250) | Nip Forming Member and Fixing Belt Damaged | X |
| Al6032 T832 (104) | SUS304 ½H (250) | Nip Forming Member and Fixing Belt Undamaged | ○ |
| SUS304 ½H (250) | SUS304 ½H (250) | Nip Forming Member and Fixing Belt Undamaged | ○ |
| Ni (638) | Ni (638) | Nip Forming Member and Fixing Belt Undamaged | ○ |
| SUS304 ½H (250) | Ni (638) | Nip Forming Member and Fixing Belt Undamaged | ○ |
| Ni (638) | SUS304 ½H (250) | Nip Forming Member and Fixing Belt Undamaged | ○ |
| M2 (805) | Ni (638) | Nip Forming Member and Fixing Belt Undamaged | ○ |
| M33 high C (1076) | Ni (638) | Nip Forming Member Unworn/Fixing Belt Damaged | X |

Referring to Table 4, the hardness of the nip forming member 220 may be between about 100 and about 810 based on a Vickers hardness tester. When the hardness of the nip forming member 220 is lower than about 100, deformation may be caused by the pressing force and damage may be caused by the friction with the fixing belt 210. Also, when the hardness of the nip forming member 220 is higher than about 810, since the brittleness thereof is increased and thus the shaping thereof is difficult, the production efficiency thereof may be degraded and damage may be caused thereto by repetitive use.

Also, referring to Table 4, when both the hardness of the nip forming member 220 and the hardness of the fixing belt 210 (or the hardness of the substrate 221 of the nip forming member 220 and the hardness of the base 211 of the fixing belt 210) are between about 100 and about 810, the nip forming member 220 and the fixing belt 210 may not be damaged during the lifetime of the fixing device 200.

The thickness of the nip forming member 220 may be, for example, about 0.1 mm to about 1.0 mm. When the thickness of the nip forming member 220 is smaller than about 0.1 mm, the nip forming member 220 may be deformed by the pressing force for forming the fixing nip 201 and the friction reducing layer 281 may be damaged by the deformation. Also, the shape maintenance thereof is difficult due to the small thickness, and thus the productivity of the nip forming member 220 may be degraded. When the thickness of the nip forming member 220 is greater than about 1.0 mm, the shaping thereof is difficult. Also, since the thermal capacity of the nip forming member 220 is increased and thus the heat of the fixing belt 210 is used to heat the nip forming member 220, the heating performance of the fixing belt 210 may be degraded and the fixity thereof may be degraded.

Thus, in the case of using the material having a high hardness, the thickness of the nip forming member 220 may need to be determined in consideration of the heating performance and the productivity thereof. In particular, since the heating performance is a factor determining the FPOT, the thickness of the nip forming member 220 may need to be determined carefully in consideration of this. In the case of using AI5052 as the material of the nip forming member 220 as in the related art and in the case of using SUS304 as the material thereof, the results of measuring the time taken for the temperature of the fixing belt 210 to reach the fixing temperature (i.e., the warm-up time) are shown in Table 5 below.

TABLE 5

| | | | | | | | |
|---|---|---|---|---|---|---|---|
| Thickness of AI5250 (mm) | 0.3 | 1.2 | 1.3 | Thickness of SUS304 (mm) | 0.2 | 0.8 | 0.9 |
| Warm-up Time (sec) | 13.1 | 14.9 | 15.5 | Warm-up Time (sec) | 13.2 | 14.9 | 16.0 |

Referring to Table 5, in the case of using SUS304 having a high hardness in order to obtain a warm-up time of about 15 seconds or less, the thickness thereof may be selected as about 0.2 mm to about 0.8 mm. When the thickness thereof is smaller than about 0.2 mm, the heating performance thereof may be satisfied but the damage thereto or the productivity degradation thereof may be caused as described above.

Figure 7:
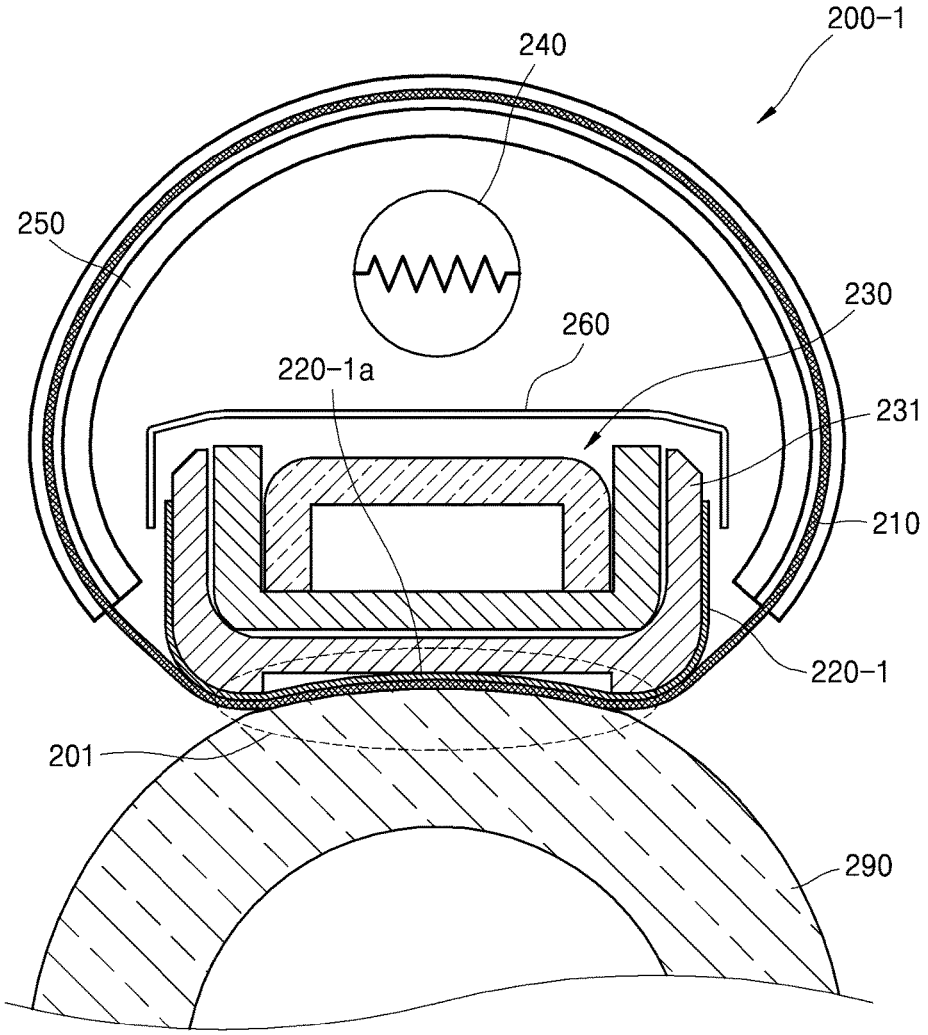
FIG. 7 is a cross-sectional view illustrating an embodiment of a fixing device.

The embodiments of the fixing device 200 are not limited to the examples illustrated in FIGS. 2 to 5. For example, the fixing nip 201 may not necessarily be flat. FIG. 7 is a cross-sectional view illustrating an embodiment of a fixing device. Referring to FIG. 7, a fixing device 200-1 of the present embodiment is different from the fixing device 200 illustrated in FIGS. 2 to 5 in that a nip forming member 220-1 is provided with a concave portion 220-1*a* for forming a fixing nip 201. The concave portion 220-1*a* is concaved toward the heating member 240. That is, the concave portion 220-1*a* is concaved toward the opposite side of the pressing member 290. The concave portion 220-1*a* may be in the form of a gentle curve. The support member 230, for example, the heat insulating member 231 may have a shape for receiving the concave portion 220-1*a*. According to this configuration, by increasing the length of the fixing nip 201, the securer fixity thereof may be obtained and the separability of the recording medium P, which has deviated from the fixing nip 201, from the fixing belt 210 may be improved.

Figure 8:
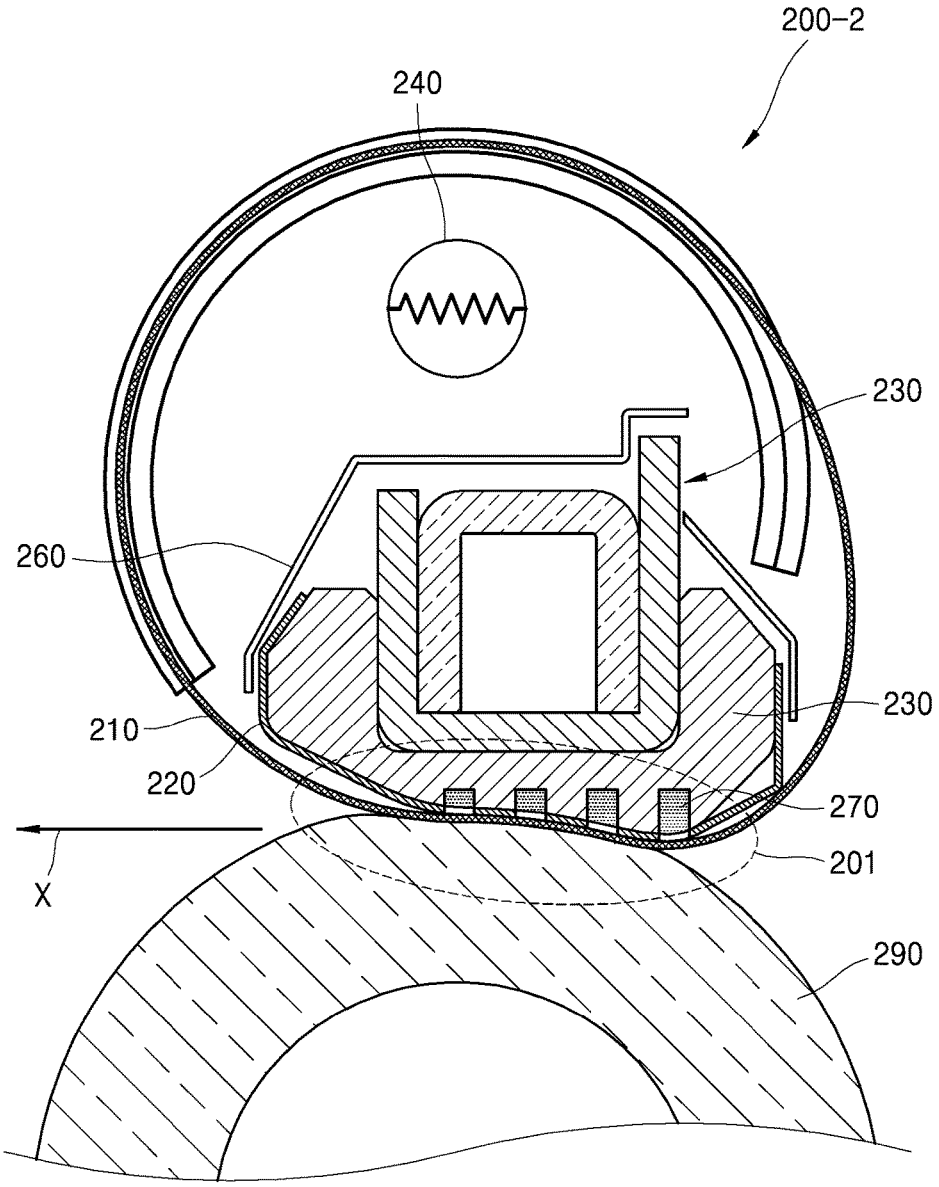
FIG. 8 is a cross-sectional view illustrating an embodiment of a fixing device.

FIG. 8 is a cross-sectional view illustrating an embodiment of a fixing device. Referring to FIG. 8, in a fixing device 200-2 of the present embodiment, the fixing nip 201 is inclined with respect to a traveling direction X of the recording medium P. The fixing nip 201 may be a plane or a curved surface. For example, the fixing nip 201 may be inclined upward in the traveling direction X of the recording medium P. Also, the center of the fixing nip 201 may be declined in the opposite direction of the traveling direction X of the recording medium P with respect to the rotation center of the pressing member 290. For example, the inclination, declination amount, and declination direction of the fixing nip 201 may be determined properly in consideration of the fixity thereof, the driving stability of the fixing belt 210 and the recording medium P, and/or the separability of the recording medium P from the fixing belt 210. The heating member 231 may be provided with a lubricating structure as illustrated in FIG. 4.

Although FIGS. 2 to 5, 7, and 8 illustrate the fixing devices 200, 200-1, and 200-2 having a mechanism for directly heating the fixing belt 210 by using the heating member 240, the heating member 240 may also indirectly heat the fixing belt 210 in the fixing nip 201 through the nip forming member 220.

Figure 9:
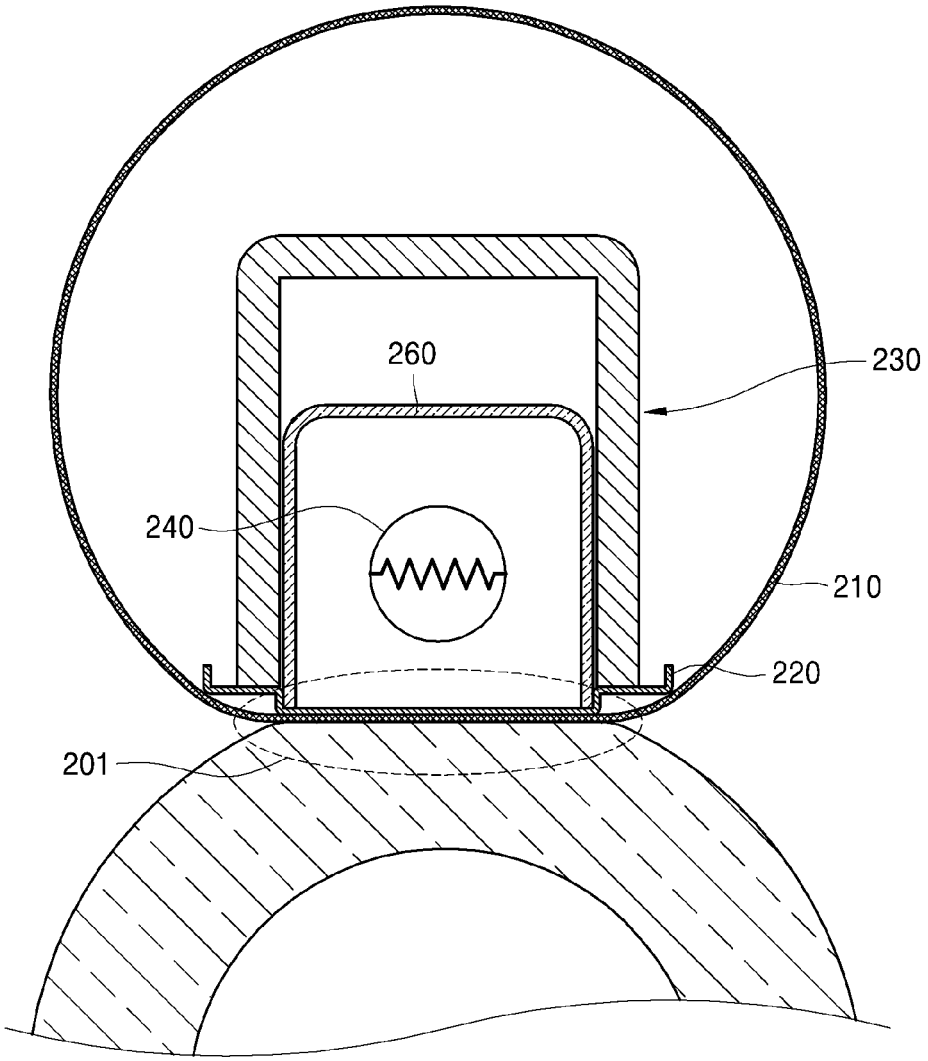
FIG. 9 is a cross-sectional view illustrating an embodiment of a fixing device.

FIG. 9 is a cross-sectional view illustrating an embodiment of a fixing device. Referring to FIG. 9, the support member 230 supports the nip forming member 220 and presses the nip forming member 220 toward the pressing member 290. For example, the support member 230 has a "U" shape with one side opened, and the nip forming member 220 is arranged at the opening side of the support member 230. The heating member 240, for example, a halogen lamp is arranged in the space defined by the nip forming member 220 and the support member 230. The nip forming member 220 is heated by the thermal energy (e.g., light) received from the heating member 240, and the thermal energy is transmitted to the fixing belt 210 to increase the temperature of the fixing belt 210 in the fixing nip 201. According to this configuration, since the fixing belt 210 is locally heated in the fixing nip 201, the temperature thereof may be rapidly increased and the thermal efficiency thereof may be improved. The reflecting plate 260 reflects the thermal energy (e.g., light) from the heating member 240 to the nip forming member 220. Accordingly, the thermal efficiency thereof may be further improved and the heating speed thereof may be further increased.

Although the inventive concept has been described with reference to the embodiments illustrated in the drawings, this is merely an example and those of ordinary skill in the art will understand that various modifications and other equivalent embodiments may be possible therefrom. Thus, the true technical scope of the inventive concept should be defined by the following claims.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A fixing device configured to fix an image to a recording medium, the fixing device comprising:

a fixing belt comprising a film base;

a nip forming member arranged inside the fixing belt;

a pressing member arranged outside the fixing belt to face the nip forming member to form a fixing nip together with the nip forming member with the fixing belt interposed between the pressing member and the nip forming member to fix the image to the recording medium; and a friction reducing sheet or a coating layer at a surface of the nip forming member, to reduce friction between the nip forming member and the fixing belt.

wherein the nip forming member has a hardness more than or equal to a hardness of the film base of the fixing belt, the nip forming member is provided with a through groove through which a lubricant passes toward the fixing belt.

2. The fixing device of claim 1, wherein the nip forming member and the film base comprise a same metal.

3. The fixing device of claim 1, wherein the film base comprises a stainless steel film; and the nip forming member comprises any one of stainless steel and nickel so that the nip forming member is configured with the hardness that is more than or equal to the hardness of the film base.

4. The fixing device of claim 1, wherein the nip forming member has a Vickers hardness of about 100 to about 810.

5. The fixing device of claim 1, wherein the nip forming member has a thickness of about 0.1 mm to about 1.0 mm.

6. The fixing device of claim 1, wherein the nip forming member comprises:

a substrate with the hardness that is more than or equal to the hardness of the film base.

7. The fixing device of claim 6, wherein the substrate comprises any one of stainless steel and nickel so that the nip forming member is configured with the hardness that is more than or equal to the hardness of the film base.

8. The fixing device of claim 1, further comprising a lubricating member supplying the lubricant.

9. The fixing device of claim 8, further comprising a support member arranged inside the nip forming member to support the nip forming member, wherein the support member is provided with a lubricating groove corresponding to the through groove of the nip forming member.

10. The fixing device of claim 1, further comprising:

a heating member heating the fixing belt with thermal energy; and a reflecting plate that reflects the thermal energy to the fixing belt.

11. The fixing device of claim 1, further comprising:

a heating member heating the fixing belt in the fixing nip indirectly through the nip forming member; and a reflecting plate reflecting thermal energy from the heating member to the nip forming member.

12. A fixing device comprising:

a flexible fixing belt comprising a metal base;

a nip forming member arranged inside the flexible fixing belt and comprising a metal substrate; and a pressing member arranged outside the flexible fixing belt to face the nip forming member to form a fixing nip together with the nip forming member with the flexible fixing belt interposed between the pressing member and the nip forming member to fix an image to a recording medium, wherein the metal substrate and the metal base are configured to have a Vickers hardness of about 100 to about 810, wherein the nip forming member is provided with a through groove through which a lubricant passes toward the fixing belt.

13. The fixing device of claim 12, wherein the hardness of the metal substrate is more than or equal to the hardness of the metal base.

14. The fixing device of claim 12, wherein the metal substrate and the metal base comprise a same metal.

15. The fixing device of claim 12, wherein the metal base comprises stainless steel; and the metal substrate comprises any one of stainless steel and nickel.

16. The fixing device of claim 12, wherein the nip forming member has a thickness of about 0.1 mm to about 1.0 mm.

17. The fixing device of claim 12, wherein the nip forming member further comprises a friction reducing coating layer provided at a surface of the metal substrate facing the flexible fixing belt.

18. The fixing device of claim 17, further comprising a lubricating member supplying the lubricant between the nip forming member and the flexible fixing belt.

19. The fixing device of claim 18, further comprising a support member arranged inside the nip forming member to support the nip forming member, wherein the support member is provided with a lubricating groove in which the lubricating member is disposed; and the through groove passes through the friction reducing coating layer.

20. An electrophotographic image forming apparatus comprising:

at least one printing developing device to form a toner image on a recording medium; and a fixing device to fix the toner image on the recording medium, the fixing device including, a fixing belt comprising a film base;

a nip forming member arranged inside the fixing belt;

a pressing member arranged outside the fixing belt to face the nip forming member to form a fixing nip together with the nip forming member with the fixing belt interposed between the pressing member and the nip forming member to fix the image to the passing through recording medium; and a friction reducing sheet or a coating layer at a surface of the nip forming member, to reduce friction between the nip forming member and the fixing belt.

wherein the nip forming member has a hardness more than or equal to a hardness of the film base of the fixing belt, the nip forming member is provided with a through groove through which a lubricant passes toward the fixing belt.

21. The electrophotographic image forming apparatus of claim 20, wherein the nip forming member and the film base comprise a same metal.

22. The electrophotographic image forming apparatus of claim 20, wherein the film base comprises a stainless steel film; and the nip forming member comprises any one of stainless steel and nickel so that the nip forming member is configured with the hardness that is more than or equal to the hardness of the film base.

23. The electrophotographic image forming apparatus of claim 20, wherein the nip forming member has a Vickers hardness of about 100 to about 810.

24. The electrophotographic image forming apparatus of claim 20, wherein the nip forming member has a thickness of about 0.1 mm to about 1.0 mm.

25. The electrophotographic image forming apparatus of claim 20, wherein the nip forming member comprises:

a substrate with the hardness that is more than or equal to the hardness of the film base.

26. The electrophotographic image forming apparatus of claim 25, wherein the substrate comprises any one of stainless steel and nickel so that the nip forming member is configured with the hardness that is more than or equal to the hardness of the film base.

27. The electrophotographic image forming apparatus of claim 20, further comprising a lubricating member supplying the lubricant.

28. The electrophotographic image forming apparatus of claim 27, further comprising a support member arranged inside the nip forming member to support the nip forming member, wherein the support member is provided with a lubricating groove corresponding to the through groove of the nip forming member.

29. The electrophotographic image forming apparatus of claim 20, further comprising:

a heating member heating the fixing belt with thermal energy; and a reflecting plate that reflects the thermal energy to the fixing belt.

30. The electrophotographic image forming apparatus of claim 20, further comprising:

a heating member heating the fixing belt in the fixing nip indirectly through the nip forming member; and a reflecting plate reflecting thermal energy from the heating member to the nip forming member.

* * * * *